United States Patent [19]

Shimek et al.

[11] Patent Number: 4,875,464

[45] Date of Patent: Oct. 24, 1989

[54] CLEAN BURNING GAS LOG BURNER SYSTEM

[76] Inventors: Ronald J. Shimek, 8944 W. 154 St., Prior Lake, Minn. 55372; Daniel C. Shimek, 5260 W. 132nd St., Apple Valley, Minn. 55124

[21] Appl. No.: 233,461

[22] Filed: Aug. 18, 1988

[51] Int. Cl.[4] ..... F24C 3/04

[52] U.S. Cl. ..... 126/92 R; 126/92 AC; 126/116 R; 126/254

[58] Field of Search ..... 126/92 R, 92 AC, 254, 126/116 R

[56] References Cited

U.S. PATENT DOCUMENTS

| | | | |
|---|---|---|---|
| 3,042,109 | 7/1962 | Peterson | 126/92 X |
| 3,385,651 | 5/1968 | Rasmussen et al. | 126/92 X |
| 3,671,175 | 6/1972 | Campbell | 126/92 R X |
| 3,696,801 | 10/1972 | Whitehead | 126/92 R |

*Primary Examiner*—Larry Jones

*Attorney, Agent, or Firm*—John B. Sowell

[57] ABSTRACT

A decorative gas burner system is provided with decorative gas logs which have openings or passageways to permit gas flames to be emitted therefrom which simulate the size and color of flames from wood burning logs. Gas burner means are mounted below the openings in said decorative gas log means and are provided with large hole arrays for producing long yellow or orange flames. Inverted U-shaped shield means are mounted over said gas burner means and provided with horizontal openings in the U-shape shield means and are further provided with deflector means opposite said openings in said shield means for producing long yellow gas flames with carbon monoxide emissions.

20 Claims, 4 Drawing Sheets

CLEAN BURNING GAS LOG BURNER SYSTEM

BACKGROUND OF THE INVENTION

1. Field of the Invention

The present invention relates to efficient gas burners for burning natural gas, manufactured gas and propane gaseous fuels. More particularly, the present invention relates to a high efficiency burner for clean burning gas fuels to provide decorative flames which simulate wood burning.

2. Description of the Prior Art

Gas logs made of fire resistant ceramic materials are well known. Heretofore when such gas logs were employed with a gas burner, the gas flame was usually directed into contact with the gas logs so as to produce an efficient clean blue flame or a highly inefficient and dirty yellow flame. Heretofore the blue flame associated with the clean burning of gas from a gas burner used in conjunction with artificial gas logs was immediately recognized as an artificial log fire flame with little or no aesthetic appeal or natural flame appearance. Alternatively the prior art pipe burners supplied an excessive amount of gas and directed the gas flames onto the gas logs which acted as a heat damper or heat sink, thus, creating excessive soot and carbon monoxide (CO). This latter type of dirty flame was found to produce an orange flame which to some extent simulates or emulates the flame produced by burning wood logs.

The Emission Pollution Control Agency of the United States government (EPA) has promulgated regulations concerning emissions standards for wood-burning stoves and wood-burning fireplaces. These regulations are placing a renewed emphasis on finding new ways to clean burn solid fuels as well as gaseous fuels which are abundantly available in the United States.

Present gas burning logs that are designed to produce decorative flames which simulate burning of wood logs either do not meet the American National Standards Institute (ANSI) emission and safety standard Z-21.50 (1986) or have been limited to producing short blue flames.

Manufacturers of gas log burner systems have heretofore placed a gas burner in a bed of sand or vermiculite to provide a sand pan burner which is placed beneath artificial gas logs. The layer of vermiculite or sand produces an appearance of smoldering or burning embers with a mixture of blue and orange flames which impinge on the ceramic logs and produce excessive amount of carbon monoxide and soot.

Another problem that arises with gas burning logs is that the burner may be adjusted to a very low flame so that the flame burns efficiently with a short blue flame and does not impinge excessively on the ceramic gas log. When such a burner system is employed the amount of heat that is produced by the gas log system is less than the heat which is lost up the chimney. When such systems are installed in a masonry fireplace, the fire underwriters require that the damper be removed from the chimney to provide an open damper system as is required for gas fuel. It has been found that attempts to use efficient short blue flames with gas burners and open damper masonry chimneys create a situation which is prone to flame out due to down draft of air in the chimney, especially in areas where high or swirling winds are present.

It has been suggested that efficient gas burners be incorporated into direct-vented gas fireplaces of the type shown and described in our co-pending application Ser. No. 927,744 filed 11 June 1986. When the prior art gas burner systems are incorporated into side vented or direct vented gas fire places of the type shown and described in application Ser. No. 927,744, they must meet the ANSI emission standards which have been adapted by the American Gas Institute. When the prior art clean burning gas burners are employed, the blue flame is not acceptable to the aesthetic eye. However, when the prior art flame is burned inefficiently to produce a yellow flame to simulate burning of natural wood it does not meet the emission standards set forth by the government and accepted by the American Gas Institute.

There is a present and long felt need for gas log burner systems which will burn clean and which simulate the flame produced by burning wood logs. Therefore, it is desirable to provide a reliable gas log burner system which produces a yellow decorative flame that simulates burning wood logs and which provides efficient usable heat and still meets the EPA regulations and ANSI emissions and safety standards.

SUMMARY OF THE INVENTION

It is a primary object of the present invention to provide a highly efficient gas burning system for use with artificial, decorative gas logs.

It is another primary object of the present invention to provide a novel burner system for use with decorative gas logs.

It is another primary object of the present invention to provide a gas log burning system which meets EPA and ANSI clean burning standards and also simulates the orange flame produced by burning wood logs.

It is another object of the present invention to provide a clean burning gas log burning system which comprises means for positioning gas logs in a predetermined position over a flame shield and deflector which mounts on a gas burner.

It is another general object of the present invention to provide a novel gas burner system which has a plurality of arrays of large gas holes and a plurality of small gas holes in the burner pipe for producing decorative yellow or orange flames of different lengths.

It is another object of the present invention to provide a clean burning gas log burning system which has a long yellow flame area with low carbon monoxide emissions and a short flame area with low carbon monoxide emissions which combine together to provide a long yellow or orange decorative flame and has acceptable low or average carbon monoxide emissions which meet EPA and ANSI standards.

According to these and other objects of the present invention, there is provided a gas log burning system having decorative gas logs with openings to permit gas flames to appear as being emitted from the artificial gas logs. A novel gas burner is mounted below and behind the gas logs for producing two different types of flames. A flame shield is mounted over the gas burner and provided with openings which force long yellow or orange gas flames to be guided through the openings in the gas logs and is further provided with a cover portion which prevents the gas flames from impinging on the artificial gas log and enhances the mixing of the gas jets with swirls of air to create an efficient, decorative flame.

DESCRIPTION OF THE PREFERRED EMBODIMENTS

Figure 1:
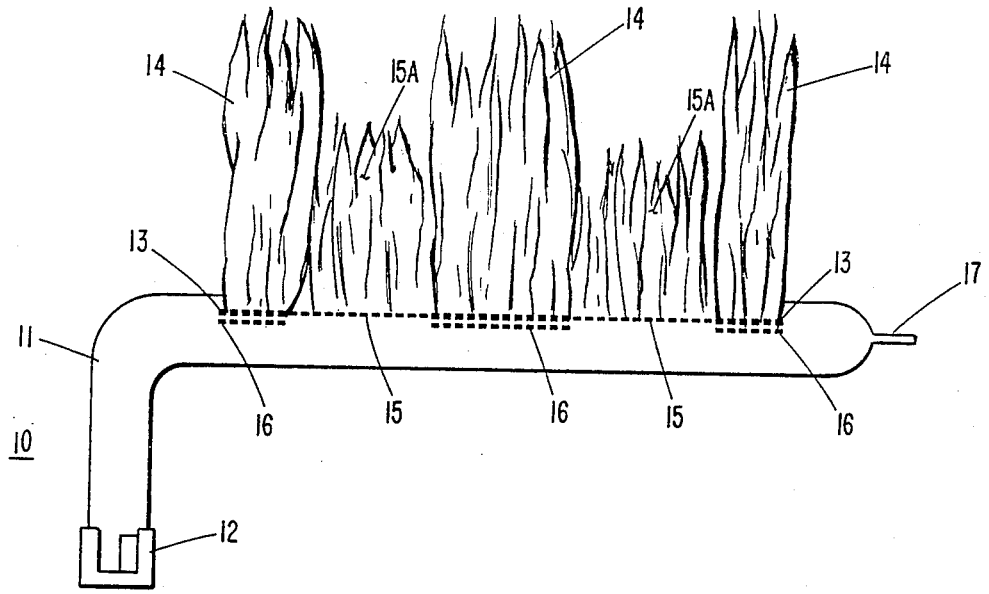
FIG. 1 is a front elevation of a simplified hollow pipe gas burner of the type employed in the present invention burner system to produce decorative yellow flames of different lengths.

Refer now to FIG. 1 which shows a burner 10 comprising a burner tube 11 and a venturi cap 12 for adjusting the air to fuel ratio. The hollow pipe burner tube 11 is provided with a plurality of arrays of large holes 13 which form gas jets. As will be explained hereinafter, the large holes 13 produce the long flames 14 which can be adjusted in height by the number of and size of holes 13 and have their color adjusted by adjustment of the venturi cap 12. A plurality of arrays of small holes 15 are arranged between the arrays of large holes 13 which produce two effects. The small holes enhance and add to the long flames 14 and also provide means for spreading or distributing the flame along the length of the burner when the gas is first ignited. A plurality of arrays of auxiliary holes 16 are provided opposite the arrays of long holes 13 to further control the height and size of the long flames 14. The end of the burner tube 11 if preferably closed to form a flange 17 which is used for mounting and supporting the burner tube 11. Burner tubes of the type shown in FIG. 1 were heretofore provided with slots or a plurality of round holes formed or punched at the top of the burner which produce one of two effects. If the amount of gas was restricted in the burner tube 11, small individual blue jets of flame were produced. If a large excess amount of gas was provided to the burner tube 11, a curtain of blue flames could be produced similar to those produced in the oven or burner of a gas stove.

Figure 2:
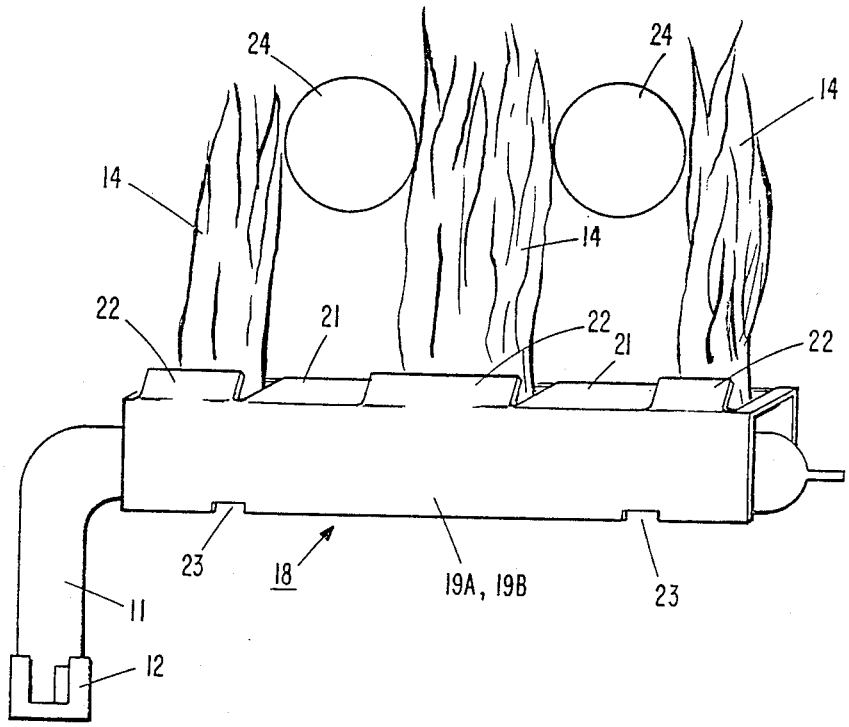
FIG. 2 is an enlarged front elevation of the hollow pipe gas burner shown in FIG. 1 having a flame directing and shaping shield mounted over the hollow pipe gas burner.

Refer now to FIG. 2 showing a front elevation of the present invention gas burner shown in FIG. 1 and having a flame directing and shaping shield mounted over the hollow burner tube 11. The flame shield 18 is preferably formed from a single sheet of stainless steel and provided with a pair of vertical side walls 19A and 19B connected by horizonal shield portions 21 and further provided with forward inclined or angular directed deflector portions 22. The flame shield 18 shown in FIG. 2 is provided with locating notches 23 which position and mount the flame shield on a grate or positioning means not shown. It is important that the flame shield 18 has its horizonal shield portions 21 located over the small hole arrays 15 so that the short flames 15A which would ordinarily engage the logs 24 are suppressed and forced to either side so as to augment and enhance the long flames 14.

Figure 3:
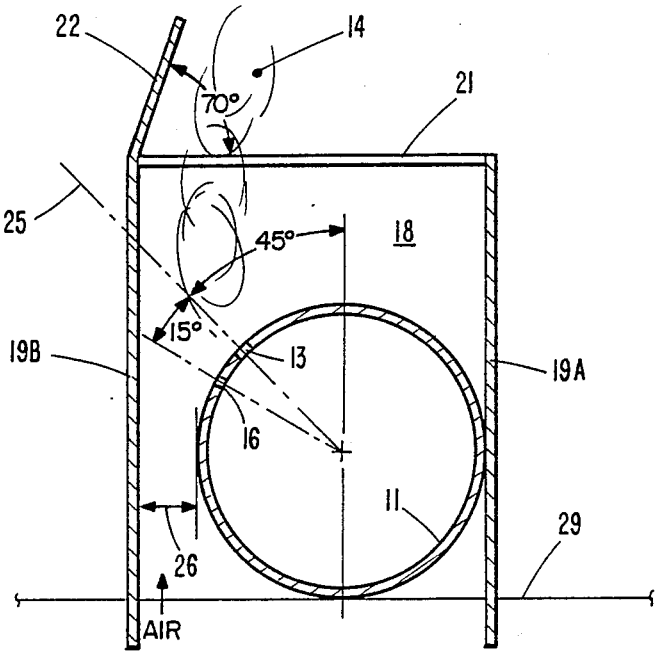
FIG. 3 has an enlarged partial section and side elevation taken at lines 3—3 of the gas burner and flame shield of FIG. 2.

Refer now to FIG. 3 showing an enlarged partial section and side elevation of the gas burner tube 11 and flame shield 18 shown in FIG. 2. FIG. 3 is a section taken at lines 3—3 of FIG. 2 showing that the holes and arrays of holes 13, 15 and 16 are in fact on the back side of the burner tube 11 and are offset from the vertical axis approximately 45°either front or back so that the jets of gas from the large holes 13 are directed along the axis 25 so as to cause the initial portion of the long flame to be deflected by the upper most portion of the vertical wall 19B and further directed by the deflector 22 in a swirling or mixing action with air which is introduced through the space 26 between the vertical wall 19B and the burner tube 11. The mixing and burning action results in the production of long flames 14 which can be made to be yellow or orange in color and yet have a small amount of carbon monoxide so as to meet EPA and ANSI emissions standards. The efficient, short blue flame being produced by the small holes 15 (which ordinarily produce the short flames 15A) are deflected or diverted by the horizontal shield 21 and add to the efficient burning decorative yellow or orange flames 14. The auxiliary holes 16 are preferably located close to and within an arc of 15°of the large holes 13 and provide a linear array pilot light for lighting the large holes 13 or maintaining the large holes lit. The amount of gas passing through the small holes is preferably insufficient to generate any appreciable flame but does add an augment flame height to the long flame 14.

Figure 4:
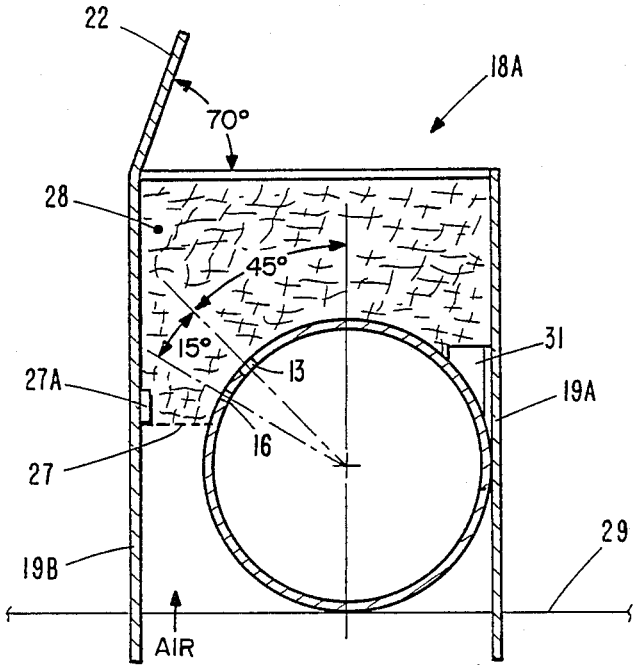
FIG. 4 is a modified enlarged partial section and side elevation of another form of gas burner of the type shown in FIG. 3.

Refer now to FIG. 4 showing a section in side elevation of modified flame shield of the type shown in FIG. 3. Shield 18A is similar to the flame shield 18 shown in FIG. 3 but is further provided with a screen 27 which forms a bottom closure for holding fireproof aggregate 28 inside the flame shield 18A. The aggregate 28 covers the large holes 13 and the holes 15, 16. The fireproof aggregate is preferably small volcanic rock or vermiculite which permits the gas jet emanating from the large holes 13 to further disperse and mix with air which enters through the screen 27 at the space 26. This modification and enhancement has been found to spread the flame sufficient to permit the angular deflector portion 22 to be raised to a higher angle or even shortened. The aggregate 28 has the effect of dispersing the long flames making them broader and only needs to be applied over the large holes 13 but may be placed along the entire length of the arrays of holes 13, 15 and 16. The vertical side walls 19A and 19B may be extended vertically downward to engage the edge 29 of a grate structure 29 or may be supported from the side of the burner tube 11 by appropriate support pieces 27A such as screen 27 attached to vertical wall 19B and a support bracket 31 attached to vertical wall 19A.

Figure 5:
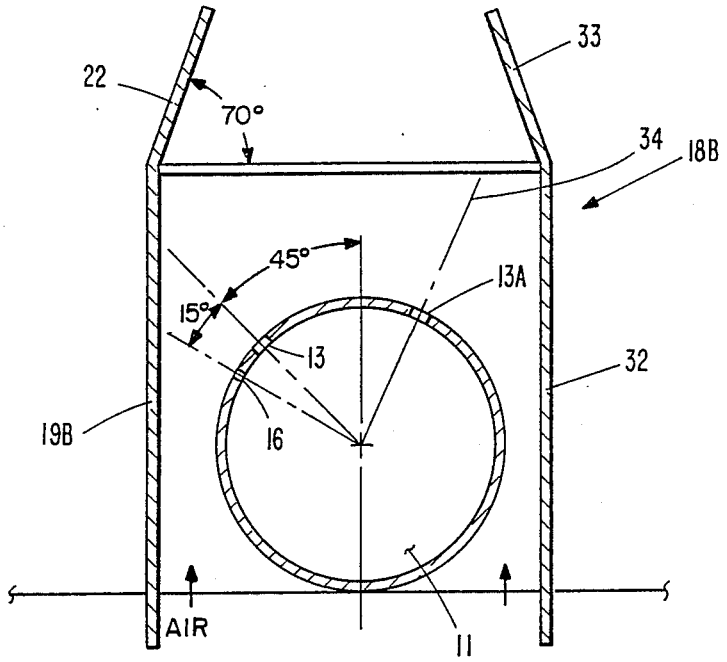
FIG. 5 is a section in side elevation of the a modified burner and flame shield of the type shown in FIGS. 3 and 4.

Refer now to FIG. 5 showing another modified flame shield 18B similar to the flame shields 18, 18A shown in FIGS. 3 and 4. Flame shield 18B is provided with a front vertical wall 32 which is spaced apart from the burner tube 11 and is further provided with an angular deflector portion 33. A second plurality of arrays of large holes 13A are shown being directed along axis 34 in a direction which causes the gas jet to impinge on deflector 33. The large holes 13 and the small holes 16 are directed toward the vertical wall 19B and deflector 22 as explained hereinbefore to achieve the same desirable result. The addition of the second deflector 33 and the second array of large gas holes 13A produces a much larger, higher and broader flame pattern than can be achieved with a single array of large holes 13. Thus, it will be understood that the location of the second array of large holes 13A could be placed adjacent to the large holes 13 similar to the auxiliary holes 16 and would produce a larger different flame pattern 14. Having explained how three different flame patterns may be achieved employing the preferred embodiment burner shown in FIG. 3 and modified embodiments burner shown in FIGS. 4 and 5, it will be understood that the flame to achieve the most efficient burning is directed away from impinging directly on the artificial and decorative logs. The embodiment shown in FIG. 5 can be employed where the logs are arranged in a log set and separated by a substantial width or distance. The flame shield 18 shown in FIG. 4 is employed in embodiment where the flame pattern requires depth. The preferred embodiment flame shield 18 shown in FIG. 3 permits the burner system to produce flames that are very long in desired regions and completely suppressed in the region under the logs or where no openings occur so that the desired color and length of flames is achieved with a smaller volume or amount of gas than was heretofore employed in the prior art where a uniform flame curtain was spread across the entire length of the burner.

Figure 6:
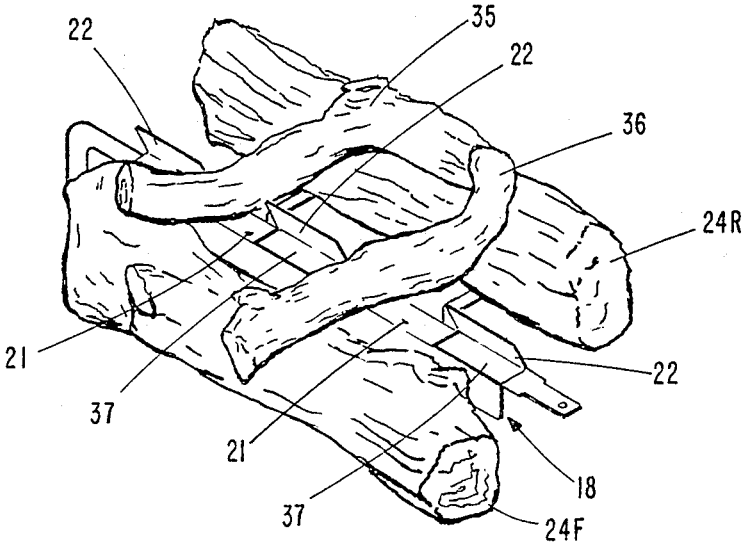
FIG. 6 is an isometric view of the gas burner shown in FIG. 2 with a four piece fireproof log set mounted over the novel flame shield and gas burner.

Refer now to FIG. 6 showing an isometric view of a four piece fireproof log set arrangement mounted over the novel flame shield 18. The flame shield and/or the grate which supports the flame shield is preferably provided with pins or extensions which cooperate with holes in the front log 24F and rear log 24R so as to accurately position them relative to the flame shield 18. Positioning means on logs 24F and 24R further provide locating means for the cross logs 35 and 36 which extend over the horizontal shield portions 21 of the flame shield 18 and prevent the flame from the burner tube 11 from impinging on the logs 35 and 36. The openings 37 in the flame shield 18 are positioned at spaces or openings where no logs occur above the openings and in the position where the long flame 14 is generated by the arrays of large holes 13 and deflectors 22. While the four piece log set is assembled in parts to provide realistic log appearance, the position of the logs relative to the long flames 14 generated by the burner system 11 are precise enough to prevent long flames 14 from impingement on the artificial logs which would produce carbon monoxide and excessive soot.

Figure 7:
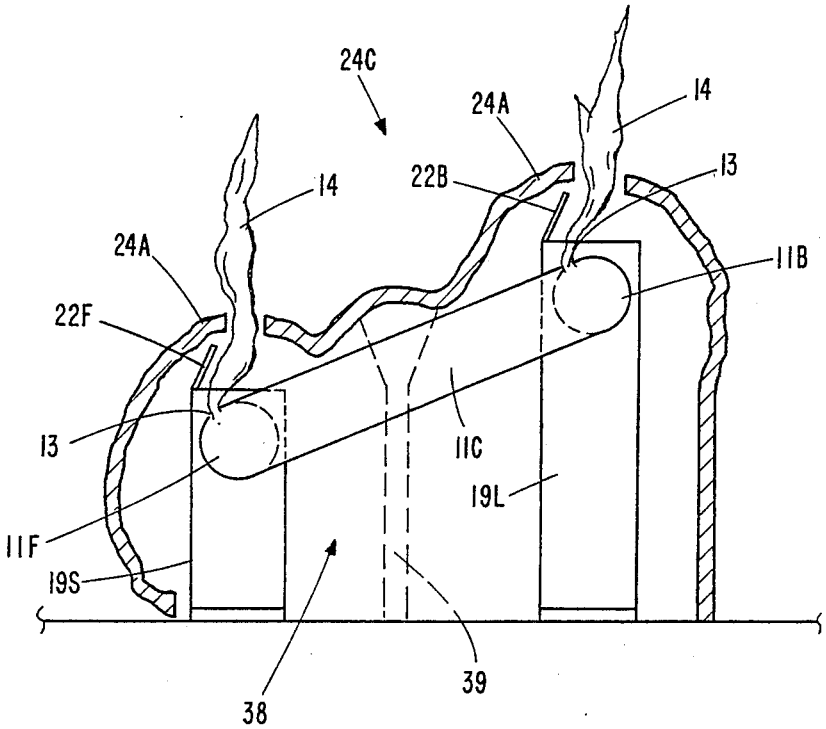
FIG. 7 is a schematic section and side elevation of a multiple level burner and composite fireproof log set mounted over a plurality of flame shields.

Refer now to FIG. 7 showing in side elevation a multiple level burner having two burner tubes 11F and 11B interconnected by a formed burner tube 11C. In this embodiment, the multi-level burner tubes 11F and 11B form a shaped and continuous burner tube of the type having large array burner holes 13 for producing the long flames 14 as well as other holes 15, 16 (not shown). It should be noted that burner tube 11F could be mounted low on the base of the fireplace and simulate glowing embers with a serpentine configuration. The deflectors 22F and 22B at the front and the back of the continuous log 24C are positioned opposite log openings 24A through which the long flames 14 extend. In this embodiment, the front wall 19S of the flame shield is extended downward to form a support for the front burner tube 11F. The vertical wall 19L of the shield shown at the rear of FIG. 7 is also extended vertically downward to form a support for the rear burner tube 11B. The continuous log 24C may take several configurations only one of which is shown in FIG. 7. An intermediate support 39 shown in phantom lines may be provided in the center of the log arrangement 24C or the log arrangement may be in two parts which lock together or connect together to form the continuous arrangement 24C.

Figure 8:
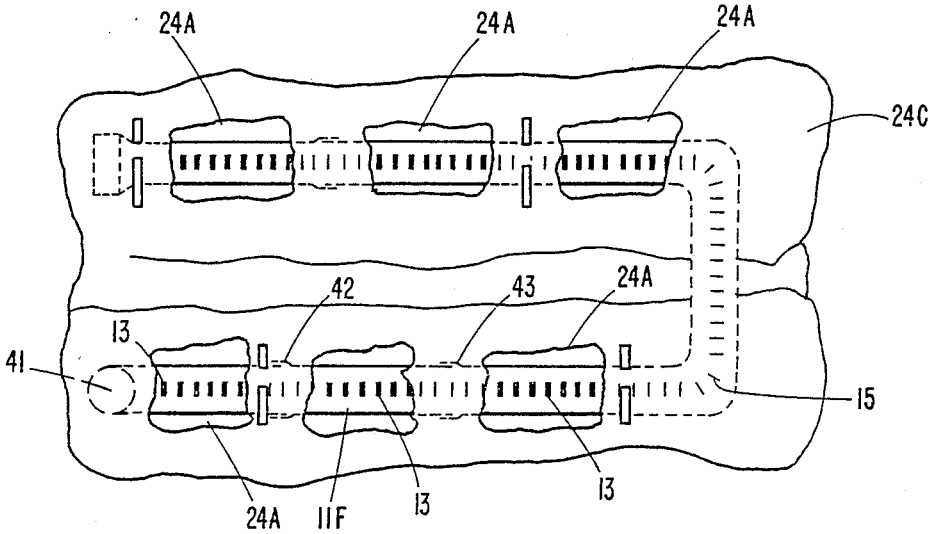
FIG. 8 is a plan view of the composite fireproof log set and burner shown in FIG. 7.

Refer now to FIG. 8 showing a top or plan view of the novel composite log set 24C and multiple level burner 11F, 11C, 11B shown in FIG. 7. The initial portion of the burner 41 comprises a vertical riser which takes a 90°turn to the horizontal portion 11F and is provided with an array of large holes 13 positioned below the first opening or aperture 24A in the composite log set 24C. The first portion of the burner terminates at a bell or socket section 42 of the tube burner and telescopes therein. Tube burner section 42 is also provided with an array of large holes 13 for producing long flames 14 and terminates at the next burner section 43. Each successive burner section 43 etc. is provided with an array of large holes where the burner section extends under an opening or aperture 24A but is only provided with an array of small holes 16 which provide the pilot light or continuous burner in sections which extend under the composite log 24C where no openings occur. Thus, it will be understood that a shield or shields having a horizontal section or sections which covers the small holes 16 is preferably to prevent the flames 15A etc. from impinging on the composite log 24C. By dividing the burner tube 11 described in the previous figures into sections which telescope together, it is possible to assemble a burner tube at different vertical levels which provides long flames at the desired composite log openings 24A. It is also possible to make the burner holes 13, 15 and 16 in a single tube at desired random offset positions and at different axial positions and then bend the continuous tube into S or U shape configurations so that the large hole arrays 13 which produce the long flames are precisely located opposite the deflector shields and the apertures 24A in the composite log 24C.

Having explained a preferred embodiment and two modifications of the flame shield employed with the preferred burner tube, it will be understood that individual modular sections of the flame shield may be placed over large hole arrays 13 to produce different flame effects at different flame elevations in a random geometric pattern. Further, it is possible to duplicate almost any natural wood burning log arrangement employing different flame deflectors and different arrays of different size holes and auxiliary holes to produce long flames, medium flames, short flames, broad flames and narrow flames occurring any place desired in a log set or composite log system. Not only can the length and the breath of the flames at desired locations be controlled with the present invention but the color of the flames can be controlled to the point where they simulate a natural log fire which is indistinguishable from a natural log fire.

It is a feature of the present invention that the flames which are used to simulate the burning of wood logs are directed in such a manner that they do not impinge on the artificial logs which would act as a heat sink and produce carbon monoxide. Further, it is another feature of the present invention that the auxiliary holes or small holes are made at very low cost and are more efficient than a pilot lighting tube which connects or bridges the large hole arrays 13. The flames from the small holes which acts as a continuous pilot light are not permitted to impinge on the artificial logs in the preferred embodiment but are directed under flame shields so as to augment and enhance the long flames being produced by the large holes 13.

The burner system shown in the preferred embodiment is designed for and is adapted to be installed in our directvented gas fireplace system shown and described in our copending U.S. application Ser. No. 927,944. The burner system has been tested to meet the requirements of the American Gas Association and the ANSI standard Z-21.50 (1986). The novel burner system exhibits all of the characteristics required of a clean burn gas system and further simulates the color and flame characteristics of a wood burning fire so that it can be incorporated into existing masonry fireplaces, wood stoves, zero clearance fireplaces, wall heaters or in top vent or direct vent gas fireplaces of the type shown in our aforementioned U.S. application and in U.S. application Ser. No. 07/200,536 filed 31 May 1988 entitled "A Universal Fireplace Assembly".

What we claim is:

1. A decorative gas log burning system, comprising:

decorative gas log means, openings in said decorative gas log means to permit gas flames to appear as being emitted from the gas log means, gas burner means mounted below said gas log means for producing large decorative gas flames directed unrestrained through said openings in said gas log means, shield means mounted over said gas burner means, said shield means having a pair of substantially vertical walls arranged on opposite sides of said gas burner means, horizontal openings in said shield means opposite the openings in said gas log means for permitting said decorative flames to escape from said shield means, and said shield means having a horizontal section connecting said vertical walls for restricting flames from said gas burner means to said openings in said gas shield means and said gas log means.

2. A decorative gas log burning system as set forth in claim 1 wherein said gas burner means comprises a continuous burner tube closed at one end, said continuous burner tube having arrays of discontinuous large holes for producing long yellow decorative gas flames, and flame propagation means located between said arrays of discontinuous large holes for conveying a flame from one of said arrays of large holes to another and for supporting said flames at all said arrays along said continuous burner tube.

3. A decorative gas log burning system as set forth in claim 2 wherein said flame propagation means comprises arrays of small holes for producing short, blue propagation flames.

4. A decorative gas log burning system as set forth in claim 3 wherein said arrays of small holes are arranged as discontinuous arrays between said large holes.

5. A decorative gas log burning system as set forth in claim 4 wherein said arrays of small holes are positioned opposite said horizontal section of said flame shield means for producing blue flames which combine and enhance with said long yellow decorative gas flames.

6. A decorative gas log burning system as set forth in claim 3 wherein said continuous burner tube of said gas burner means further includes discontinuous arrays of enhancement holes parallel to said arrays of large holes for enhancing the production of said large yellow decorative gas flames.

7. A decorative gas log burning system as set forth in claim 1 wherein said shield means further includes deflector means connected to said shield means in the path of said decorative gas flames.

8. A decorative gas log burning system as set forth in claim 7 wherein said deflector means provides a hot wall for mixing burning gasses to provide a curtain of long yellow decorative gas flames.

9. A decorative gas log burning system as set forth in claim 8 wherein said deflector means extends at an inclined angle over said horizontal openings in said shield means for directing said curtain of yellow decorative gas flames through said openings in said gas log means.

10. A decorative gas log burning system as set forth in claim 7 wherein said deflector means is formed from a portion of said horizontal openings in said gas shield means.

11. A decorative gas log burning system as set forth in claim 7 wherein said deflector means comprises two oppositely disposed deflectors connected to said vertical walls of said shield means.

12. A decorative gas log burning system as set forth in claim 7 wherein one of said vertical walls is spaced apart from said gas burner means to provide a space for combustion air to enter from below said burner tube.

13. A decorative gas log burner system as set forth in claim 7 wherein said deflector means comprises a plurality of deflectors each being connected to one of said vertical walls.

14. A decorative gas log burner system as set forth in claim 13 wherein said deflectors are arranged opposite each other on opposite vertical walls and said vertical walls are spaced apart from said burner tube.

15. A decorative gas log burner system as set forth in claim 1 wherein one of said vertical walls is spaced apart from said burner tube and is provided with a screen to allow combustion air to enter between the vertical wall and said burner means, and fireproof aggregate means covering said burner tube and said screen means, said fireproof means aggregate being supported by said vertical walls and said screen means.

16. A decorative gas log burner system as set forth in claim 1 wherein said decorative log means comprises a composite log having a plurality of apertures therein, and said gas burner means comprising a continuous irregular shaped burner tube having a plurality of arrays of large holes, each array of large holes being arranged individually below one of said plurality of said openings in said composite gas log means.

17. A decorative gas log burner system as set forth in claim 16 wherein said shield means comprises a plurality of individual shields mounted over said gas burner means at said arrays of large hole.

18. A decorative gas log burner system as set forth in claim 16 wherein said gas burner means comprises a plurality of burner tube portions having said plurality of large hole arrays which are interconnected with burner tube portion having means for providing a continuous pilot or flame between said large hole arrays, and individual shield means having horizontal sections connecting said side walls for mounting on said irregular shaped burner tube.

19. A method of clean burning gas fuel under decorative gas logs comprising the steps of:

arranging decorative logs over an elongated gas burner of the type having large burner holes at the point where large decorative flames are desired, providing openings in said decorative logs through which said decorative flames are to be directed, placing a flame directing shield over said elongated burner to direct said decorative flame through said openings in said decorative logs, and placing openings in said flame shield opposite said large burner holes and aligned with said openings in said decorative logs so that gas fuel leaving said large burner holes is simultaneously burned and directed through the openings in said gas logs without the major portion of the decorative flames engaging against said decorative logs and losing heat thereto which would diminish the clean burning of said gas fuel.

20. A method as set forth in claim 19 which further includes the step of directing said decorative flames directly through said openings in said decorative logs without impinging on said decorative logs.

* * * * *